US005190682A

United States Patent [19]

Harris

[11] Patent Number: 5,190,682

[45] Date of Patent: Mar. 2, 1993

[54] LUBRICANT MIXTURES AND GREASE COMPOSITIONS BASED THEREON

[75] Inventor: John W. Harris, Oakville, Canada

[73] Assignee: Shell Oil Company, Houston, Tex.

[21] Appl. No.: 857,906

[22] Filed: Mar. 26, 1992

[30] Foreign Application Priority Data

May 20, 1991 [GB] United Kingdom ..... 9110838

[51] Int. Cl.[5] ..... C10M 107/08; C10M 111/04

[52] U.S. Cl. ..... 252/56 S; 585/10; 585/12

[58] Field of Search ..... 585/10, 12; 252/56 S

[56] References Cited

U.S. PATENT DOCUMENTS

| | | | |
|---|---|---|---|
| 3,382,291 | 5/1968 | Brennan | 585/521 |
| 3,742,082 | 6/1973 | Brennan | 585/255 |
| 3,769,363 | 10/1973 | Brennan | 585/255 |
| 3,838,049 | 9/1974 | Souillard et al. | 585/12 |
| 4,075,112 | 2/1978 | Van Doorne | 585/12 |
| 4,406,800 | 9/1983 | Christian | 252/56 S |
| 5,049,291 | 9/1991 | Miyaji et al. | 252/56 S |
| 5,072,067 | 12/1991 | Koyama et al. | 585/12 |

FOREIGN PATENT DOCUMENTS

WO 89/12672 12/1989 PCT Int'l Appl. .

OTHER PUBLICATIONS

"Lubrication and Lubricants", *Kirk-Othmer Encyclopedia of Chemical Technology*, 3rd ed., vol. 14, pp. 477-524.

James A. Brennan, "Wide-Temperature Range Synthetic Hydrocarbon Fluids", *Ind. Eng. Chem. Prod. Res. Dev.*, 1980, 19, pp. 2-6.

*Primary Examiner*—Ellen McAvoy

[57] ABSTRACT

This invention provides lubricant mixtures for use as base fluid in open-gear grease comprising 10% to 90% w of a liquid polybutene having a viscosity at 38° C. in the range of 1,000 to 20,000 $mm^2/s$ and a viscosity at 100° C. in the range of 40 to 500 $mm^2/s$, and 10% to 90% of a liquid polyalphaolefin having a viscosity at 38° C. in the range of 10 to 75 $mm^2/s$ and a viscosity at 100° C. in the range of 2 to 15 $mm^2/s$, and open-gear grease compositions containing a major proportion of such lubricant mixtures.

7 Claims, No Drawings

LUBRICANT MIXTURES AND GREASE COMPOSITIONS BASED THEREON

FIELD OF THE INVENTION

This invention relates to lubricant mixtures and to grease compositions based thereon, particularly open-gear grease compositions.

BACKGROUND OF THE INVENTION

Synthetic, poly-alpha-olefins (PAO), such as 1-decene oligomers, have found wide acceptability and commercial success in the lubricant field for their superiority to mineral oil-based lubricants. In terms of lubricant properties improvement, industrial research effort on synthetic lubricants has led to PAO fluids exhibiting useful viscosities over a wide range of temperatures, i.e., improved viscosity index (VI), while also showing lubricity, thermal and oxidative stability and pour point equal to or better than mineral oil.

These relatively new synthetic lubricants lower mechanical friction, enhancing mechanical efficiency over the full spectrum of mechanical loads from worm gears to traction drives, and do so over a wider range of ambient operating conditions than mineral oil. The PAO's are prepared by the polymerization of 1-alkenes using typical Lewis acid or Ziegler-catalysts. Their preparation and properties are described by J. Brennan in *Ind. Eng. Chem. Prod. Res. Dev.*, 1980, 19, pp. 2–6. PAO incorporating improved lubricant properties are also described by J. A. Brennan in U.S. Pat. Nos. 3,382,291, 3,742,082, and 3,769,363.

In accordance with customary practice in the lubricants art, PAO's have been blended with a variety of functional chemicals, oligomeric and high polymers and other synthetic and mineral oil-based lubricants to confer or improve upon lubricant properties necessary for applications such as engine lubricants, hydraulic fluids, gear lubricants, etc. Blends and their components are described in *Kirk-Othmer Encyclopedia of Chemical Technology*, third edition, volume 14, pages 477–526. A particular goal in the formulation of blends is the enhancement of the viscosity index by the addition of VI improvers which are typically high molecular weight synthetic organic molecules. While effective in improving the viscosity, these VI improver have been found to be deficient in that their very property of high molecular weight, which makes them useful as VI improvers, also confers upon the blend a vulnerability in shear stability during actual use applications.

Open gear greases are used for lubrication generally of open gears and bushings, and have particular application in lubrication of, for example, boom point sheaves, crowd/retract sheave antifriction bearings, hoist drum bearings, crowd drum bearings, hoist intermediate gear cases, hoist intermediate shaft bearings, hoist motor shaft bearings and transverse shaft bearings in crawler final drive cases. Such greases have typically been based on asphalt (bitumen)/high viscosity index mineral oil blends, and it has usually been necessary to incorporate a chlorinated solvent, e.g., 1,1,1-trichloroethane, in order to facilitate low temperature mobility of the grease (to assist pumping thereof), e.g., for cold climates such as Canada or northern Europe. Once the grease is in place, the chlorinated solvent evaporates off. Since chlorinated solvents such as 1,1,1,-trichloroethane have been implicated in ozone depletion of the earth's upper atmosphere, avoidance of their use would be advantageous.

It would be advantageous to have a lubricant composition useful for base fluids for open-gear greases which did not require a viscosity improver or chlorinated solvents.

SUMMARY OF THE INVENTION

It has now been found that blends of certain low-viscosity poly-alpha-olefins and certain branched polybutenes are very effective lubricant mixtures for use as the primary components, i.e., base fluids, for open-gear greases. The present invention consists of open-gear greases containing a mixture of a liquid polybutene and of a liquid polyalphaolefin, both having a specified viscosities.

DESCRIPTION OF THE PREFERRED EMBODIMENTS

The present invention includes a lubricant mixture for use as a base fluid in open-gear grease. A component is 10% w to 90% w of a liquid polybutene having a viscosity at 38° C. in the range of 1,000 $mm^2/s$ to 20,000 $mm^2/s$ and a viscosity at 100° C. in the range of 40 $mm^2/s$ to 500 $mm^2/s$. Another component is 10% to 90% w of a liquid polyalphaolefin having a viscosity at 38° C. in the range of 10 $mm^2/s$ to 75 $mm^2/s$ and a viscosity at 100° C. in the range of 2 $mm^2/s$ to 15 $mm^2/s$.

Preferably the lubricant mixture comprises 20% to 80% w of the polybutene and 20% to 80% w of the polyalphaolefin, more preferably 50% to 70% w, e.g., 55 to 65% w, of the polybutene and 30% to 50% w, e.g., 35 to 45% w, of the polyalphaolefin.

Polybutenes, including polyisobutenes, having the required viscosity characteristics are known materials. Preferably the polybutene has a viscosity at 38° C. in the range of 4,000 to 16,000 $mm^2/s$ and a viscosity at 100° C. in the range of 100 to 400 $mm^2/s$, advantageously a viscosity at 38° C. in the range of 6,000 to 12,000 $mm^2/s$, more preferably 7,000 to 10,000 $mm^2/s$ and a viscosity at 100° C. in the range of 150 to 300 $mm^2/s$, more preferably 180 to 250 $mm^2/s$.

Polyalphaolefins having the required viscosity characteristics are also known materials. Polyalphaolefins can be prepared, for example, by polymerization of ethylene in a plurality of stages to produce a product predominating in alpha olefins as described in U.S. Pat. No. 3,482,000 which reference is incorporated herein by reference. Preferably the polyalphaolefin has a viscosity at 38° C. in the range of 10 to 60 $mm^2/s$, more preferably 20 to 45 $mm^2/s$, e.g., 25 to 35 $mm^2/s$, and a viscosity at 100° C. in the range 3 to 12 $mm^2/s$, more preferably 4 to 9 $mm^2/s$, e.g., 5 to 8 $mm^2/s$.

The invention further provides an open-gear grease composition which comprises a major proportion of a lubricant mixture of the invention as defined above in admixture with a thickener and at least one additional component selected from solid lubricants, extreme pressure additives, stabilizers, anti-oxidants, and anti-corrosion additives. Clay thickeners are particularly suitable, e.g., bentonite-derived clay thickeners, e.g., in amounts in the range of 2 to 10% w, preferably 2 to 6% w. Propylene carbonate may be added in small amounts, e.g., 0.1 to 0.5% w, as clay activator.

Additional components may be present in amounts in the range of 0.1 to 20% w, although the total amount of such components plus thickener will constitute less than 50% w of the grease composition. Extreme pressure additives include lead naphthenate, other organic metal salts, sulphurized fatty oils, other sulphurized organic compounds, graphite, molybdenum disulfide, carbon black, and castor oil. Glycerol may be incorporated as enhancer for extreme pressure additives. Anti-corrosion additives include nitrites such as sodium nitrite, organic metal salts and sulphurized fatty oils. Anti-oxidants include phenothiazines such as N-benzylphenothiazine, phenolic compounds, aromatic amines, organic metal salts and sulphurized fatty oils. Mixtures of such additives, as well as other well-known additives, may be used.

The invention will be further understood from the following illustrative examples, which should not be construed as limiting.

EXAMPLE 1

An open-gear grease was prepared according to the following formulation:

| Component | % by weight |
|---|---|
| Thickener[1] | 3 |
| Propylene carbonate | 0.3 |
| Water | 0.3 |
| Polybutene[2] | 46.7 |
| Polyalphaolefin[3] | 31.2 |
| Glycerol | 2 |
| Castor oil | 2 |
| Graphite[4] | 7 |
| Molybdenum disulfide | 3 |
| Carbon black | 3 |
| Extreme pressure additive[5] | 1.5 |

[1]Organoclay thickener.
[2]A highly-branched polybutene having a viscosity of 8,000 $mm^2/s$ (Cst) at 38° C. and 200 $mm^2/s$ (Cst) at 100° C. (ASTM D 88).
[3]A polyalphaolefin having a viscosity of 30 $mm^2/s$ (Cst) at 38° C. and 6 $mm^2/s$ (Cst) at 100° C.
[4]A graphite of average particle size 20 microns containing a maximum of 2% w ash.
[5]A substituted 1,3,4-thiadiazole extreme pressure additive.

The polybutene and polyalphaolefin were blended together (in weight proportion 60:40) to give a base oil blend having a viscosity of 430 $mm^2/s$ (Cst) at 38° C. and 32 $mm^2/s$ (Cst) at 100° C.

Forty percent of the resulting base oil blend, the thickener and the propylene carbonate, were stirred together at 50° C. for 20 minutes in a Hobart grease kettle, and the resulting mixture was passed one through a three-roll mill.

To this mixture were then added the remaining additives and stirring was continued at 80° C. for 20 minutes, after which the remaining 60% w of the base oil blend was added with stirring until a homogeneous grease was obtained.

The resulting grease was subjected to the following tests: Four Ball EP test (ASTM D 2596), Four Ball Wear test (ASTM D 2266), Mobility test (US Steel DM 43) and US Steel Retention. Result are given in the Table following:

TABLE

| Text | Result |
|---|---|
| 4-Ball EP Weld Load (kg) | 800 |
| 4-Ball Wear Scar diameter (mm) | 0.51 |
| Mobility at −40° C., g/min | 0.18 |
| US Steel Retention at 15 kg (33 lb) time to failure (minutes) | 26 to 30 (pass) |

EXAMPLE 2

An open gear grease was prepared having the formulation of Example 1, by blending the polybutene and polyalphaolefin as in Example 1, stirring together in a Hobart grease kettle at 80° C. for 20 minutes 40% w of the resulting base oil blend, the thickener and the propylene carbonate, passing the resulting mixture once through a three-roll mill, adding the water, glycerol, castor oil and the remaining 60% w of the base oil blend, passing the mixture again through the roll mill, returning the mixture to the grease kettle and stirring in the graphite, the molybdenum disulfide, the carbon black and the extreme pressure additive, to obtain a homogeneous grease.

The resulting grease was thicker than that of Example 1 but had comparable performance properties.

What is claimed is:

1. A lubricant mixture for use as a base fluid in open-gear grease consisting essentially of from about 55% w to about 65% w of a liquid polybutene having a viscosity at 38° C. in the range of 1,000 $mm^2/s$ to 20,000 $mm^2/s$ and a viscosity at 100° C. in the range of 40 $mm^2/s$ to 500 $mm^2/s$, and from about 30% w to about 50% w of a liquid polyalphaolefin having a viscosity at 38° C. in the range of 10 $mm^2/s$ to 75 $mm^2/s$ and a viscosity at 100° C. in the range of 2 $mm^2/s$ to 15 $mm^2/s$.

2. The lubricant mixture according to claim 1 wherein the polybutene has a viscosity at 38° C. in the range of 4,000 $mm^2/s$ to 16,000 $mm^2/s$ and a viscosity at 100° C. in the range of 100 $mm^2/s$ to 400 $mm^2/s$.

3. The lubricant mixture according to claim 2 wherein the polybutene has a viscosity at 38° C. in the range of 6,000 $mm^2/s$ to 12,000 $mm^2/s$ and a viscosity at 100° C. in the range of 150 $mm^2/s$ to 300 $mm^2/s$.

4. The lubricant mixture according to claim 2 wherein the polyalphaolefin has a viscosity at 38° C. in the range of 10 $mm^2/s$ to 60 $mm^2/s$ and a viscosity at 100° C. in the range of 3 $mm^2/s$ to 12 $mm^2/s$.

5. The lubricant mixture according to claim 4 wherein the polyalphaolefin has a viscosity at 38° C. in the range of 20 $mm^2/s$ to 45 $mm^2/s$ and a viscosity at 100° C. in the range of 4 $mm^2/s$ to 9 $mm^2/s$.

6. An open-gear grease composition which comprises a major proportion of a lubricant mixture according to claim 1 in admixture with a thickener and at least one additional component selected from solid lubricants, extreme pressure additives, stabilizers, anti-oxidants, and anti-corrosion additives.

7. A lubricant mixture for use as a base fluid in open-gear grease consisting essentially of from about 55% w to about 65% w of a liquid polybutene having a viscosity at 38° C. in the range of 6,000 $mm^2/s$ to 12,000 $mm^2/s$ and a viscosity at 100° C. in the range of 150 $mm^2/s$ to 300 $mm^2/s$ and 30% w to 50% w of a liquid polyalphaolefin having a viscosity at 38° C. in the range of 20 $mm^2/s$ to 45 $mm^2/s$ and a viscosity at 100° C. in the range of 4 $mm^2/s$ to 9 $mm^2/s$.

* * * * *